US007445487B1

(12) United States Patent
Guethoff et al.

(10) Patent No.: US 7,445,487 B1
(45) Date of Patent: Nov. 4, 2008

(54) AUXILIARY CONNECTOR FOR A ROW OF TERMINALS

(75) Inventors: Ralf Guethoff, Paderborn (DE); Thomas Kulke, Detmold (DE)

(73) Assignee: Weidmuller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/982,528

(22) Filed: Nov. 2, 2007

(30) Foreign Application Priority Data

Nov. 28, 2006 (DE) ..... 20 2006 018 152 U

(51) Int. Cl.
*H01R 13/64* (2006.01)

(52) U.S. Cl. ..... 439/374

(58) Field of Classification Search ..... 439/374, 439/257, 41–42, 190, 587, 676, 76.2, 638–639
See application file for complete search history.

(56) References Cited

U.S. PATENT DOCUMENTS 3,529,806 A * 9/1970 Kozel ..... 251/129.21
4,515,426 A * 5/1985 Bager ..... 439/140
7,334,543 B2 * 2/2008 Pawellek ..... 123/41.1

* cited by examiner

*Primary Examiner*—Jean F Duverne
(74) *Attorney, Agent, or Firm*—Lawrence E Laubscher, Sr; Lawrence E Laubscher, Jr

(57) ABSTRACT

An auxiliary connector device connects a conductor with an electrical component mounted in a terminal block upon which the connector device is mounted, including a contact arrangement extending through aligned outlet and entry openings contained in the auxiliary connector device and the terminal block, respectively, thereby to connect with the electrical component a bus bar to which the conductor is clamped. The contact arrangement includes a contact screw rotatably connected at one end with the auxiliary connector device and in electrical engagement with the bus bar, the other end of the contact screw being threadably connected with the terminal block. Upon rotation of the screw in a given direction; a contact sleeve arranged concentrically about the screw is longitudinally displaced into electrical engagement with the electrical component. The auxiliary contact device is sectional, thereby to permit use of a selected one of a plurality of contact arrangements having different lengths.

14 Claims, 4 Drawing Sheets

AUXILIARY CONNECTOR FOR A ROW OF TERMINALS

BACKGROUND OF THE INVENTION

1. Field of the Invention

An auxiliary connector device connects a conductor with an electrical component mounted in a terminal block upon which the connector device is mounted, including a contact arrangement extending through aligned outlet and entry openings contained in the auxiliary connector device and the terminal block, respectively, thereby to connect with the electrical component a bus bar contained within the connector device and to which the conductor is clamped. The contact arrangement includes a contact screw rotatably connected at one end with the auxiliary connector device and in electrical engagement with the bus bar, the other end of the contact screw being threadably connected with the terminal block, said screw being rotatable to longitudinally displace the sleeve into electrical engagement with the electrical component.

2. Description of Related Art

The current state of the art requires a considerable effort if, on already assembled terminal block arrangements, a supply voltage is to be subsequently connected with the arrangement to supply power to electrical appliances, such as, for example, small systems with monitoring circuits, sockets or the like.

Against this background, the object of the present invention is to create a simply handled auxiliary connector for connecting a conductor to the terminal blocks, by means of which the above described problems can be solved, subsequently, without separating any of the existing conductor connections.

The auxiliary connector device of the present invention can be operated in a simple manner and, to that extent, in a simple and secure manner, makes it possible to tap a supply voltage on already installed and assembled terminal blocks.

The chosen design, by exchanging just a few elements—such a sleeve and screw contact assembly—facilitates an adaptation to the various structural spacing distances of terminal blocks provided with or without lateral distribution elements extending between a row of terminal blocks.

SUMMARY OF THE INVENTION

Accordingly, a primary object of the present invention is to provide an auxiliary connector device mounted on a terminal block for connecting a conductor to an electrical component contained in the terminal block, use being made of a contact arrangement of a selected length extending from the electrical component to a bus bar mounted in the connector device and to which the conductor is clamped via entry opening contained in the terminal block and a corresponding outlet opening contained in the support body.

According to a more specific object of the invention, the contact arrangement comprises a conductive contact screw rotatably connected at one end with the auxiliary connector support body in electrical engagement with the bus bar, and a conductive tubular sleeve arranged concentrically about, and in electrical engagement with, the screw. At its free end, the extremity of the contact screw is threadably connected with the terminal block adjacent the electrical component, whereby upon rotation of the screw, the sleeve is displaced longitudinally toward engagement with the electrical component, whereby the bus bar is connected with the electrical component via the contact screw and the sleeve arrangement.

The sleeve may be internally threaded for threaded connection with the contact screw, or it may be fixed upon the screw.

According to a further object of the invention, the auxiliary support member comprises a pair of hingedly connected body sections that are pivotable between closed and open positions, thereby to permit the selection of one of a plurality of contact screw-sleeve arrangements of different lengths in accordance with the spacing distance between the electrical component and the top surface of the terminal block upon which the auxiliary connector device is mounted. The support body contains a first access opening that permits rotation of the contact screw by means of an operating tool, such as the tip of a screwdriver. A second access opening permits access to a clamping screw for clamping the conductor to the bus bar.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1B:
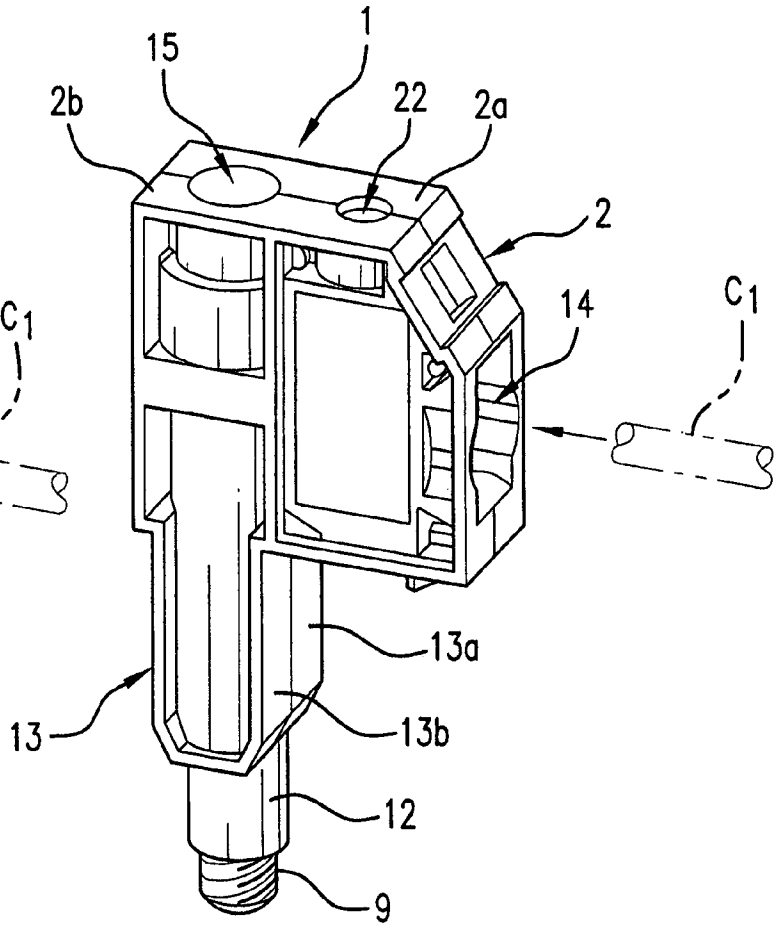
FIGS. 1*a* and 1*b* are perspective views of the auxiliary connector device of the present invention when in the open and closed conditions, respectively.
Figure 1A:
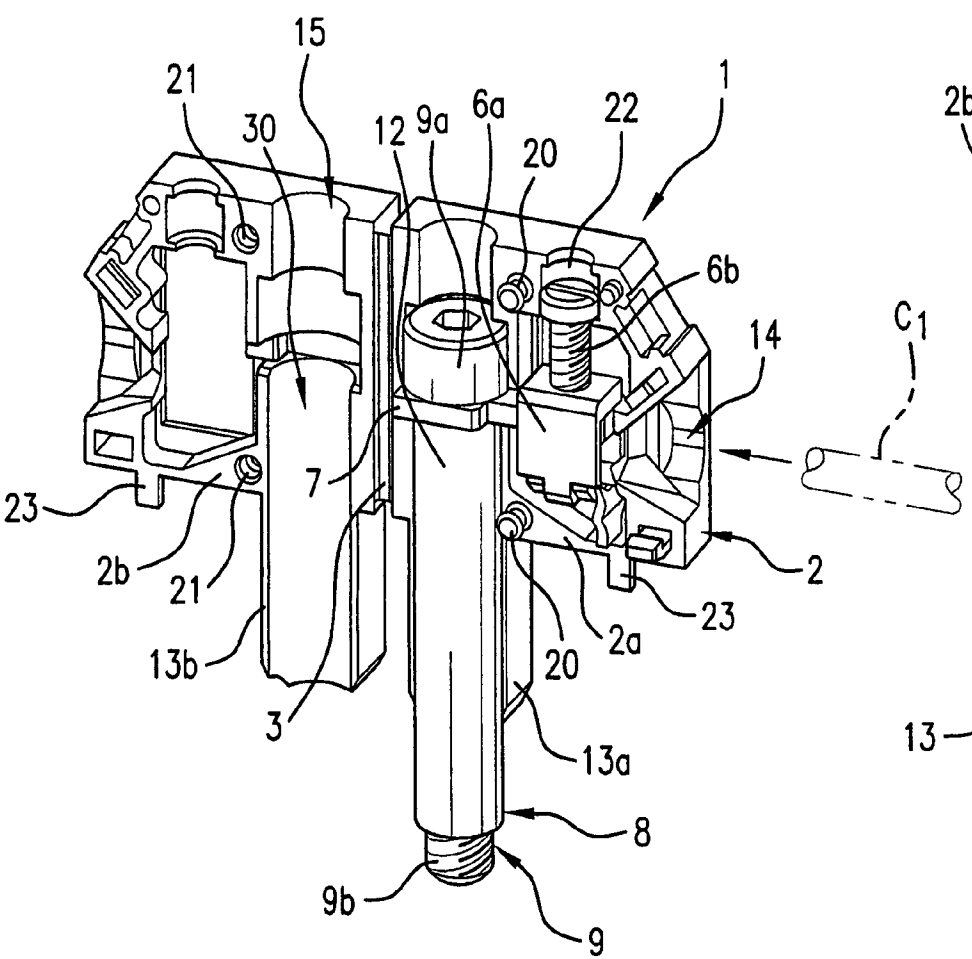

Referring first more particularly to FIGS. 1*a* and 1*b*, the auxiliary connector device 1 of the present invention includes a sectional generally-rectangular support body 2 that is longitudinally divided to define a pair of body sections 2*a*, 2*b* that are hingedly connected by the flexible integral hinge strip 3. As will be described in greater detail below, the body sections are pivotable between the open condition of FIG. 1*a*, and the closed condition of FIG. 1*b*, corresponding snap fastener pins 20 and openings 21 being provided for normally retaining the sections in the closed condition. The support body is formed from an electrically-insulating synthetic plastic material.

Mounted within a chamber contained in the support body 2 are a bus bar 7, and a clamping device 6 including a conductive housing 6*a* and a clamping screw 6*b*. The clamping device serves to clamp to the bus bar a conductor $C_1$ that is inserted into the clamping device via an inlet opening 14 contained in one end of the support body. A contact arrangement 8 extends outwardly from the bottom of the support body via an orthogonally arranged outlet opening 30, which contact arrangement includes a conductive internally-threaded contact sleeve 12 that is arranged in the outlet opening 30, and a rotatable contact screw 9 that is threadably connected within, and extends concentrically through, the contact sleeve.

The support body 2 includes an integral tubular mounting lug 13 that is arranged concentrically about the outlet opening and extends downwardly concentrically about the contact sleeve 12. The contact screw 9 includes a shaft portion that extends upwardly through an opening or slot contained in the bus bar 7, which screw shaft portion terminates at its upper extremity in an enlarged head portion 9*a* that is in electrical engagement with the upper surface of the bus bar. At its lower end 9*b*, the screw shaft portion terminates in a threaded extremity that extends downwardly from the lower end of the contact sleeve 12. The support body contains a first access opening 15 opposite the enlarged head portion 9*a* of the contact screw, and a second access opening 22 opposite the head portion of the clamping screw 6*b*.

Figure 2:
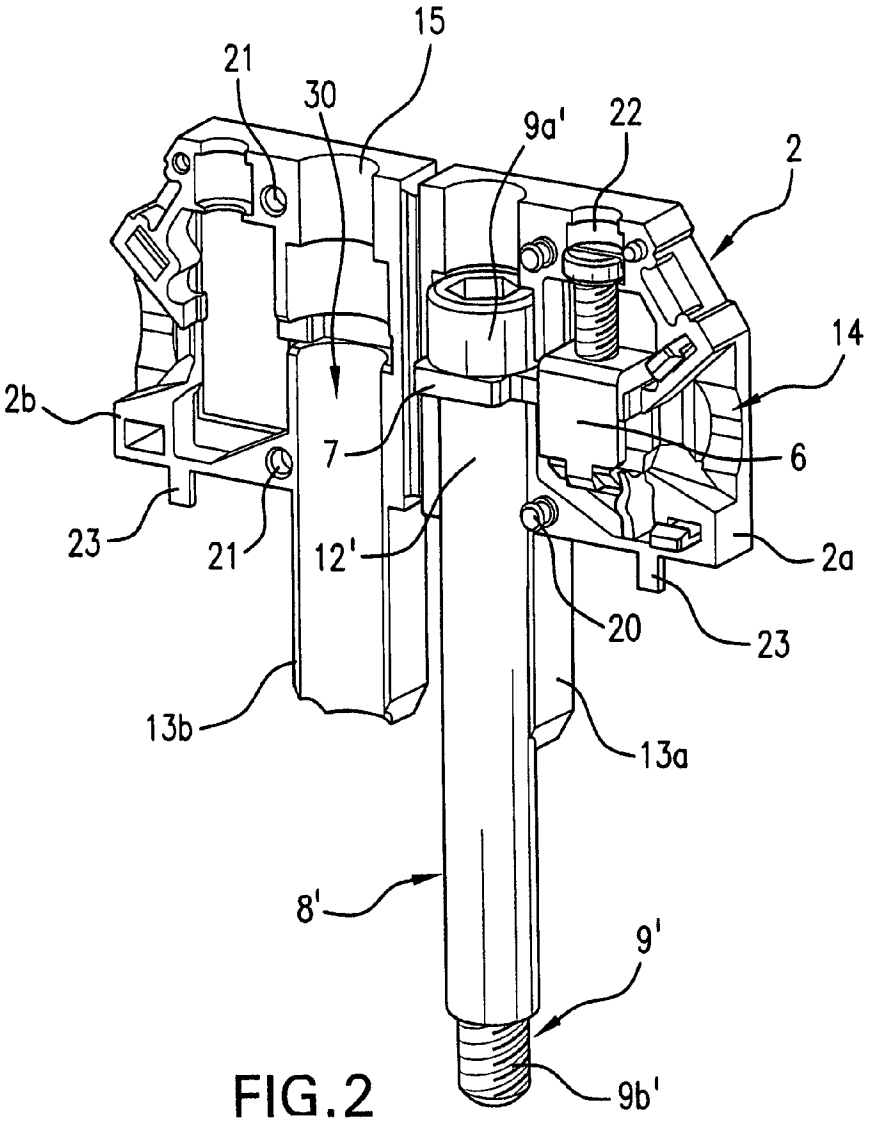
FIGS. 2 and 3 are perspective view of the apparatus of FIG. 1*a* having pairs of screw contact and sleeve assemblies of large and medium lengths, respectively.
Figure 3:
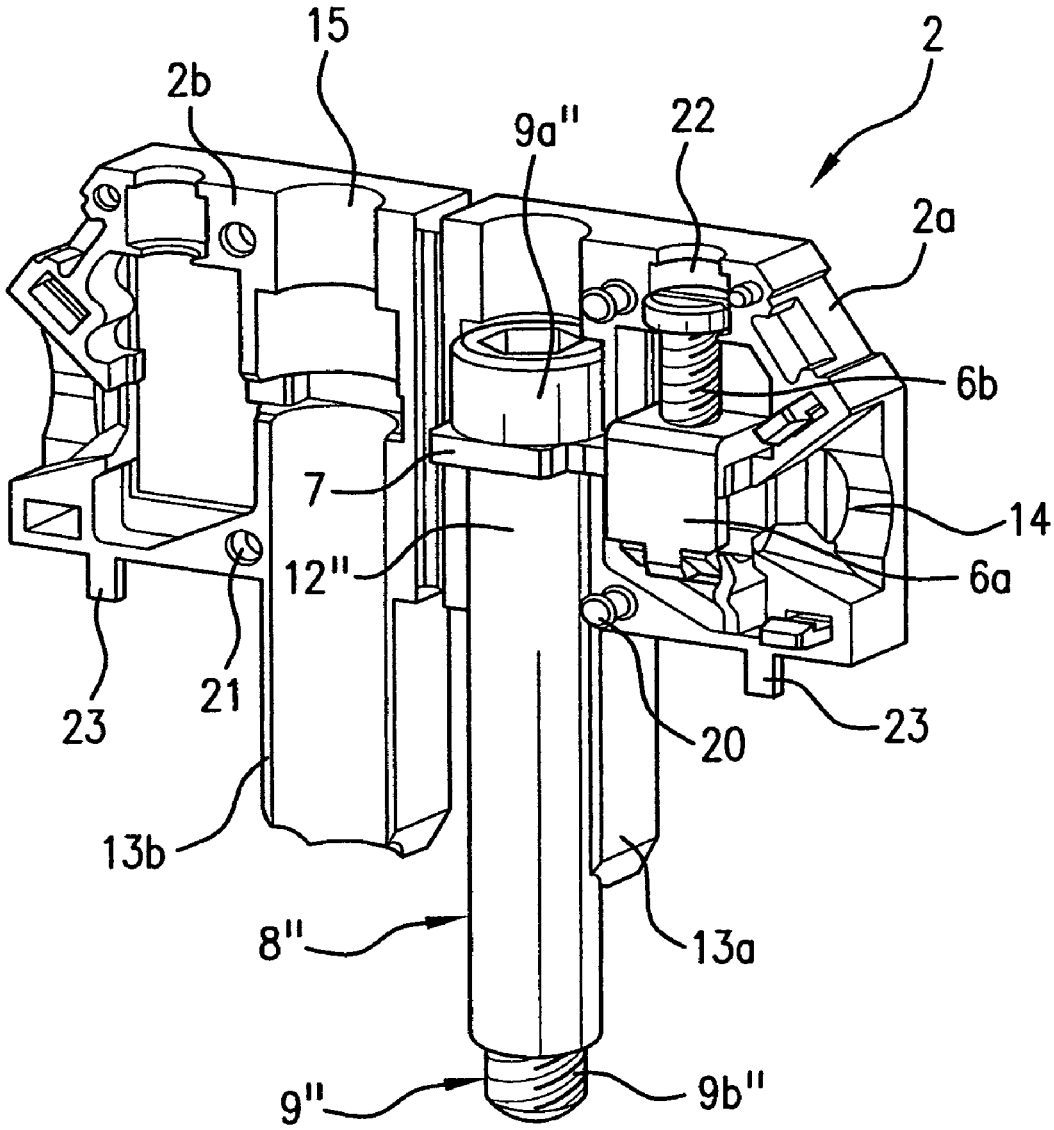
Figure 4B:
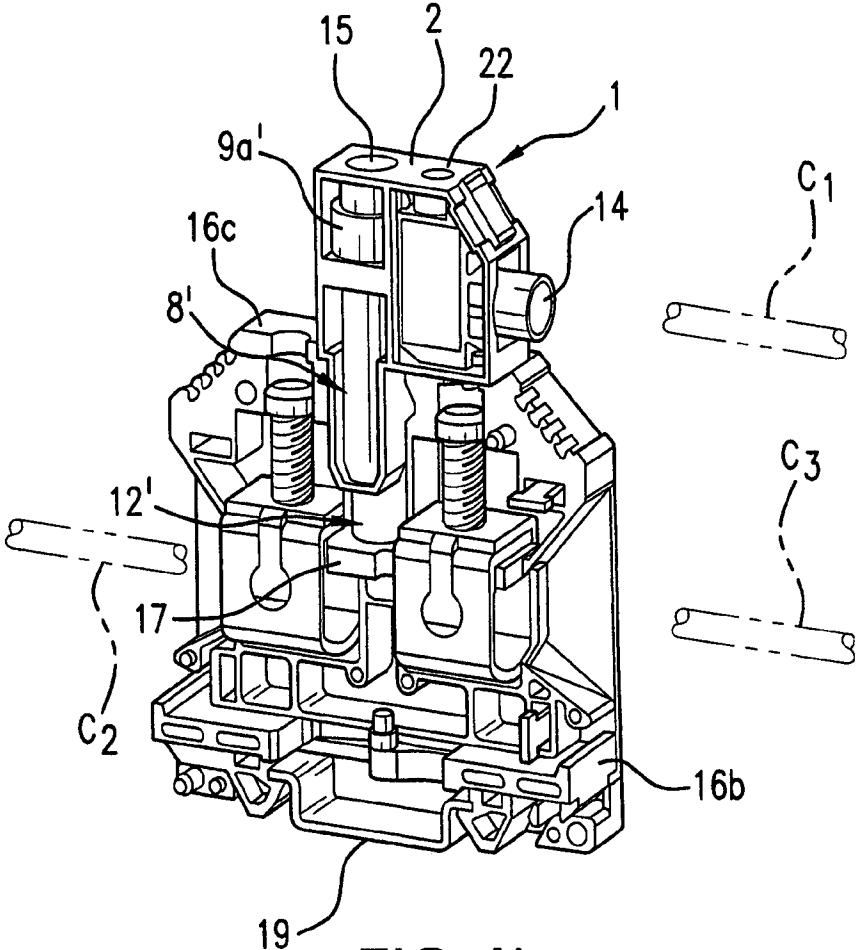
FIGS. 4*a* and 4*b* are perspective views illustrating the manner of connecting the short length and long length auxiliary connectors of FIGS. 1*b* and 2 with two different terminal block arrangements, respectively.
Figure 4A:
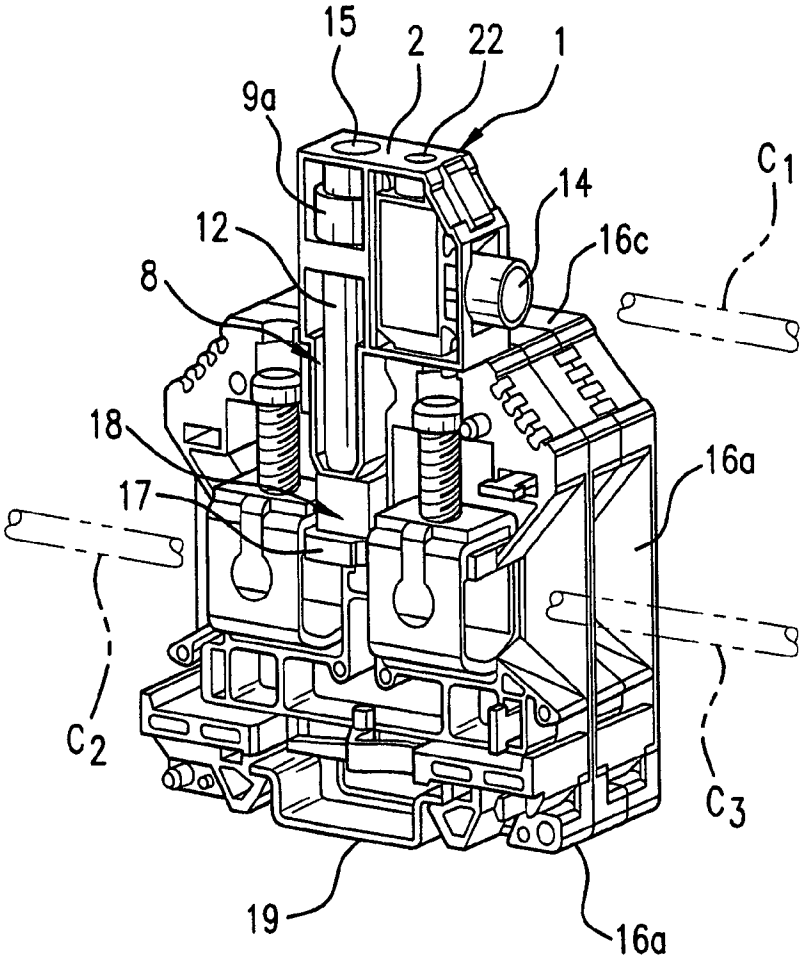

According to an important feature of the invention, when the sectional support body is in the open condition of FIG. 1*a*, the screw and sleeve contact assembly 8 may be replaced by a relatively-long contact assembly 8', as shown in FIG. 2, or by a contact assembly 8" of medium length, as shown in FIG. 3. As shown in FIGS. 4*a* and 4*b*, the auxiliary connector device 1 is adapted for mounting on the top surface 16*c* of a terminal block to connect the conductor $C_1$ to an electrical component contained in the terminal block. In the embodiment of FIG. 4*a*, the electrical component that is engaged by the relatively short sleeve 12 of the contact means 8 is a cross-connecting distributor element 18 that extends transversely between a row of terminal blocks 16*a*. This cross connector distributor element 18 is in electrical engagement with the individual internal bus bars 17 of each of the terminal blocks of the row. In the embodiment of FIG. 4*b*, a contact assembly 8' of longer length is provided, wherein the conductor $C_1$ is directly connected with the internal bus bar 17 of an individual terminal block 16*b* by the contact sleeve 12'.

Figure 1C:
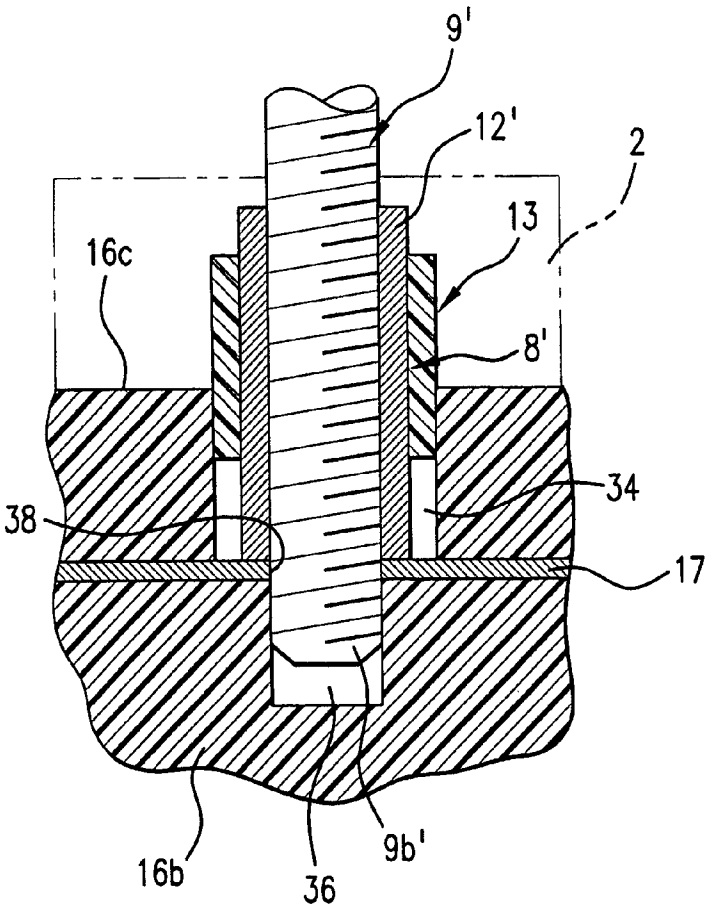
FIG. 1*c* is a detained sectional view illustrating the manner of electrical connection of the apparatus of FIG. 1*b* with a terminal block.

Referring to FIGS. 1*c* and 4*d*, when the auxiliary connector 1 is mounted on the upper surface of the terminal block 16, the tubular lug on the support body 2 and the associated contact assembly 8' extend into the entry opening 34 contained in the upper surface of the terminal block 16*b*. The lower end 9*b'* of the contact screw extends through an opening or slot contained in the bus bar 17 and is threadably connected with a counterbore 36 defined within the entry opening 34. The screw 9' may be of the self-tapping type, or, if the counterbore 36 is threaded, of a size and type suitable for connection with the screw threads of the counterbore. In either case, when the contact screw 9 is rotated in a given direction by the tip of a tool inserted into the access opening 15, the sleeve 12 is axially threadably displaced longitudinally downwardly into electrical engagement with the upper surface of the bus bar 17. Thus, the bus bar 7 contained within the auxiliary support body 2 is connected with the bus bar 17 contained within the terminal block 16*b* via the enlarged head portion 9*a'* of the contact screw, and the sleeve, 12 that is threadably connected with the shank portion of the contact screw, the lower extremity of the sleeve being is in electrical engagement with the upper surface of the individual bus bar 17.

Similarly, in the multiple terminal block arrangement of FIG. 4*a*, the contact assembly 8 is of a shorter length, so that the lower extremity of the sleeve 12 engages the upper surface of the transversely extending distributor member 18. In this arrangement, the conductor $C_1$ is connected with the bus bars of the various terminal blocks of the row via the distributor element 18.

Differing lengths of auxiliary accessory connections 1 on the other hand can be made in a simple manner by the selection or a corresponding screw length of the screw 9, as shown in FIGS. 1*a*-3.

Secure protection against rotation or lateral displacement of the auxiliary connector on the terminal block is guaranteed by integral stabilizing projections 23 that extend downwardly from the bottom of the support body into correspond stabilizing recesses contained in the top surface of the terminal block.

The invention thus also creates an advantageous system of accessory connections, whereby the accessory connections of the system in each case display a screw/sleeve arrangement 8 with screws 9 and/or sleeves 12, having differing lengths. Thus, a given conductor $C_1$ may be connected with the conductors $C_2$ and $C_3$ of a single terminal block, or with selected conductors of a row of terminal blocks. In the embodiment of FIG. 4*a*, the contact screw 9 extends through openings in the bus bar 7, the sleeve 12, the electrical component 18 and the bus bar 17, the free extremity of the screw being threadably connected within a corresponding bore contained in the associated terminal block of the row. In the embodiment of FIG. 4*b*, the contact screw extends through openings contained in the bus bar 7, the sleeve 12, and the bus bar 17, the end extremity of the screw being threadably connected with the counterbore 36.

The clamping means 6 may be of the insulation piercing type, or of the type adapted for connection with the stripped bare end of an insulated conductor.

While in accordance with the provisions of the Patent Statutes the preferred form and embodiments of the invention have been illustrated and described, it will be apparent to those skilled in the art that changes may be made without deviating from the invention described above.

What is claimed is:

1. An auxiliary connector device for electrically connecting a conductor with an electrical component contained in a terminal block housing, comprising:

(a) a generally rectangular terminal block (16*a*, 16*b*) containing a first chamber, said terminal block having a horizontal top surface (16*c*) containing an entry opening communicating with said first chamber;

(b) at least one electrical component (17, 18) mounted in said first chamber adjacent said entry opening;

(c) an auxiliary support body (2) mounted on said terminal block top surface, said support body containing a second chamber, said terminal block and said support body each being formed from an electrically insulating synthetic plastic material, said support body containing inlet (14) and outlet (30) openings communicating with said second chamber, said outlet opening being opposite said terminal block entry opening;

(d) a bus bar (7) mounted in said second chamber adjacent said inlet and outlet openings;

(e) clamping means (6) mounted in said second chamber for clamping in electrical engagement with said bus bar the end of a conductor ($C_1$) introduced into said second chamber via said inlet opening; and (f) electrically conductive contact means (8) mounted in said support body outlet opening and extending into said terminal block entry opening, said contact means being in electrical engagement at opposite ends with said bus bar and with said electrical component, respectively.

2. An auxiliary connector device as defined in claim 1, wherein said contact means comprises:

(1) a conductive contact screw (9) having a first end portion (9*a*) in electrical engagement with said bus bar, said contact screw having a second end portion (9*b*) that extends into said second chamber via said entry opening; and (2) connecting means electrically said contact screw with said one electrical component, said connecting means including a tubular sleeve arranged in said outlet opening concentrically about and electrically connected with said contact screw.

3. An auxiliary connecting device as defined in claim 2, and further wherein;

(a) said contact screw first end portion extends through an opening contained in said bus bar and terminates in an enlarged head portion (9*a*) in electrical engagement with said bus bar;

(b) said contact screw second end extending through an opening (38) contained in said electrical component and terminates in an extremity that is threadably connected within a bore (36) contained in said terminal block, whereby upon rotation of said contact screw in a given direction relative to said terminal block, said sleeve is displaced to cause one extremity thereof to be in electrical engagement with said one component.

4. An auxiliary connecting device as defined in claim 3, wherein said sleeve is internally threaded, said sleeve being threadably connected with said contact screw.

5. An auxiliary connecting device as defined in claim 3, wherein said sleeve is fixed upon said contact screw.

6. An auxiliary connecting device as defined in claim 3, wherein said support body includes a tubular integral mounting lug portion (13) arranged concentrically outwardly about said outlet opening, said mounting lug portion extending within said entry opening concentrically about said contact sleeve.

7. An auxiliary connecting device as defined in claim 6, wherein said support body includes at least one stabilizing projection (23) that extends within a corresponding stabilizing opening contained in said terminal block top surface, thereby to prevent rotation of said support body about said outlet opening relative to said terminal block.

8. An auxiliary connector device as defined in claim 2, wherein said support body contains a first access opening (15) communicating with said second chamber opposite said enlarged screw head portion, said enlarged head portion containing a non-circular recess for receiving the tip of an operating tool inserted into said first access opening, thereby to rotate said screw relative to said support body and said terminal block.

9. An auxiliary connector device as defined in claim 8, wherein said clamping means includes a clamping screw (6*b*); and further wherein said support body includes a second access opening (22) opposite said clamping screw.

10. An auxiliary connector device as defined in claim 3, wherein said support body is sectional and is longitudinally divided into a pair of sections (2*a*, 2*b*) that are pivotally connected by hinge means (3) for displacement between open and closed positions: and further including a plurality of associated pairs of contact screws and sleeves having different effective operating lengths (9, 12; 9', 12'; 9", 12"), whereby when said support member sections are in the open position, a pair of said contact screw and sleeve elements may be inserted in said support body in accordance with the spacing distance between an electrical component mounted in said terminal block relative to said terminal block top surface.

11. An auxiliary connector device as defined in claim 1, wherein said support body inlet and outlet openings are orthogonally arranged relative to each other.

12. An auxiliary connector device as defined in claim 1, wherein a plurality of said terminal blocks are arranged in side-by-side relation; and further wherein said electrical component is a cross-bus-bar member (18) that electrically connects together said terminal blocks.

13. An auxiliary connector device as defined in claim 1, wherein said clamping means includes insulation piercing means.

14. An auxiliary connector device as defined in claim 1, wherein said clamping means is operable to clamp to said bus bar the stripped bare end of an insulated conductor.

* * * * *